US010609965B2

(12) United States Patent
Lee

(10) Patent No.: US 10,609,965 B2
(45) Date of Patent: Apr. 7, 2020

(54) BRASSIERE

(71) Applicant: Eunsung Lee, Seoul (KR)

(72) Inventor: Eunsung Lee, Seoul (KR)

( * ) Notice: Subject to any disclaimer, the term of this patent is extended or adjusted under 35 U.S.C. 154(b) by 0 days.

(21) Appl. No.: 15/769,343

(22) PCT Filed: Jul. 4, 2016

(86) PCT No.: PCT/KR2016/007151
§ 371 (c)(1),
(2) Date: Apr. 19, 2018

(87) PCT Pub. No.: WO2017/069380
PCT Pub. Date: Apr. 27, 2017

(65) Prior Publication Data

US 2018/0303171 A1 Oct. 25, 2018

(30) Foreign Application Priority Data

Oct. 21, 2015 (KR) ..... 10-2015-0146858

(51) Int. Cl.
*A41C 3/00* (2006.01)
*A41F 1/00* (2006.01)
*A41C 3/12* (2006.01)

(52) U.S. Cl.
CPC ..... *A41C 3/0028* (2013.01); *A41C 3/12* (2013.01); *A41F 1/006* (2013.01)

(58) Field of Classification Search
CPC ..... A41C 3/0028; A41C 3/12; A41F 1/006
(Continued)

(56) References Cited

U.S. PATENT DOCUMENTS 2,668,954 A * 2/1954 Frohlich ..... A41F 1/006 450/82
2,736,899 A * 3/1956 Ayres ..... A41F 1/006 450/82

(Continued)

FOREIGN PATENT DOCUMENTS

JP 3065764 U 2/2000
KR 20-0303757 Y1 2/2003

(Continued)

OTHER PUBLICATIONS

International Search Report for PCT/KR2016/007151 dated Nov. 25, 2016 from Korean Intellectual Property Office.

*Primary Examiner* — Timothy K Trieu
(74) *Attorney, Agent, or Firm* — Revolution IP, PLLC

(57) ABSTRACT

A brassiere includes: first and second connecting bands extending from cups to the left and right; a plurality of hooks provided on an end portion of the first connecting band; a plurality of stopping loops provided on an end portion of the second connecting band in multiple columns, the plurality of hooks being engaged with, or disengaged from, the plurality of loops; and a resilient band provided between the first and second connecting bands, wherein the end portion of the second connecting band includes: a stationary band portion on which, among the plurality of stopping loops, stationary stopping loops, the positions of which are fixed, are arranged; and a mobile band portion on which, among the plurality of stopping loops, mobile stopping loops, the positions of which are movable, are arranged, wherein the mobile band portion can resiliently move toward or away from the stationary band portion.

3 Claims, 8 Drawing Sheets

(58) Field of Classification Search
USPC ..... 450/86
See application file for complete search history.

(56) References Cited

U.S. PATENT DOCUMENTS

| | | | | |
|---|---|---|---|---|
| 7,232,359 | B1 * | 6/2007 | Richardson | A41C 3/0028 450/1 |
| 8,408,964 | B1 * | 4/2013 | Acker | A41C 3/0028 2/336 |

FOREIGN PATENT DOCUMENTS

| | | | |
|---|---|---|---|
| KR | 20-0343284 | Y1 | 3/2004 |
| KR | 20090118978 | * | 12/2009 |
| KR | 10-2011-0062298 | A | 6/2011 |
| KR | 10-2012-0016983 | A | 2/2012 |
| KR | 20-0475301 | Y1 | 12/2014 |

* cited by examiner

【Figure 1】
Related Art
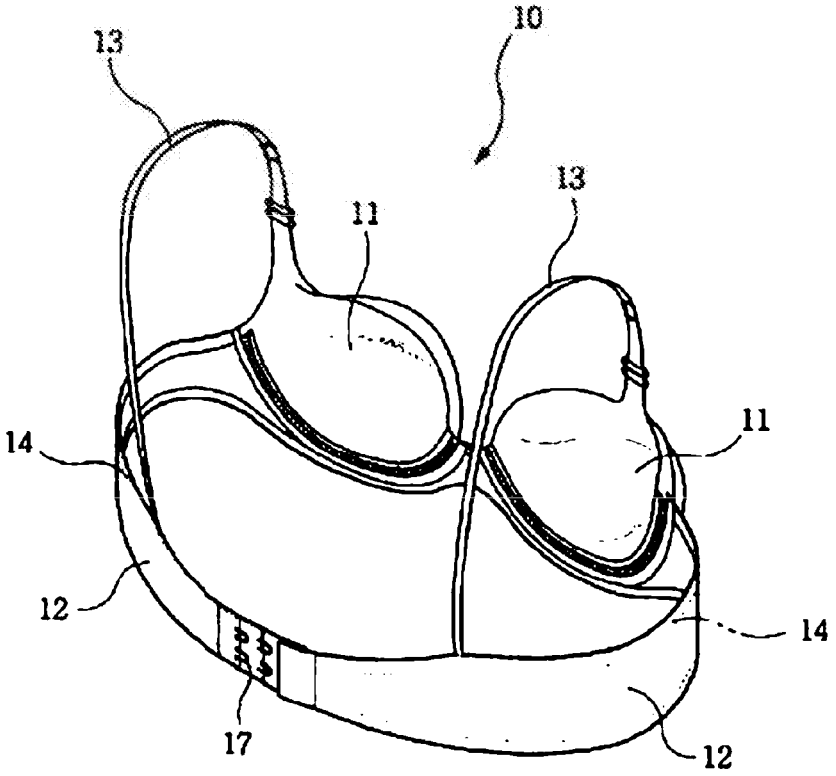
【Figure 2】
Related Art
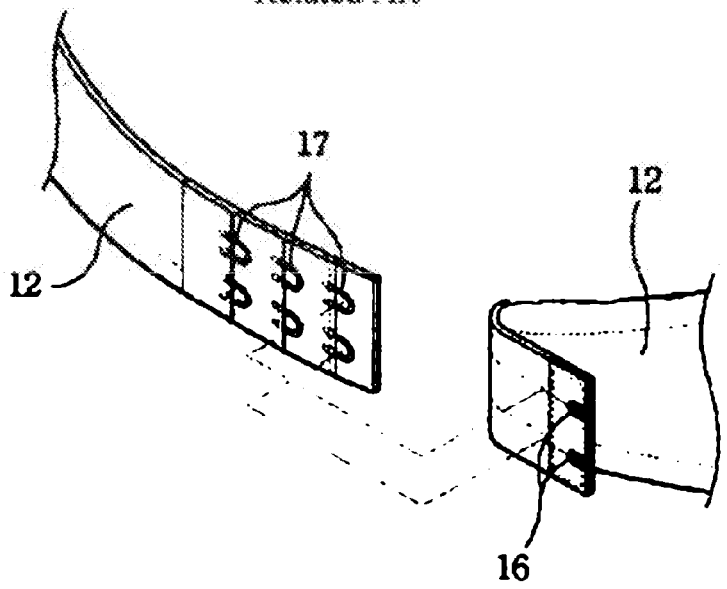

【Figure 3】
Related Art
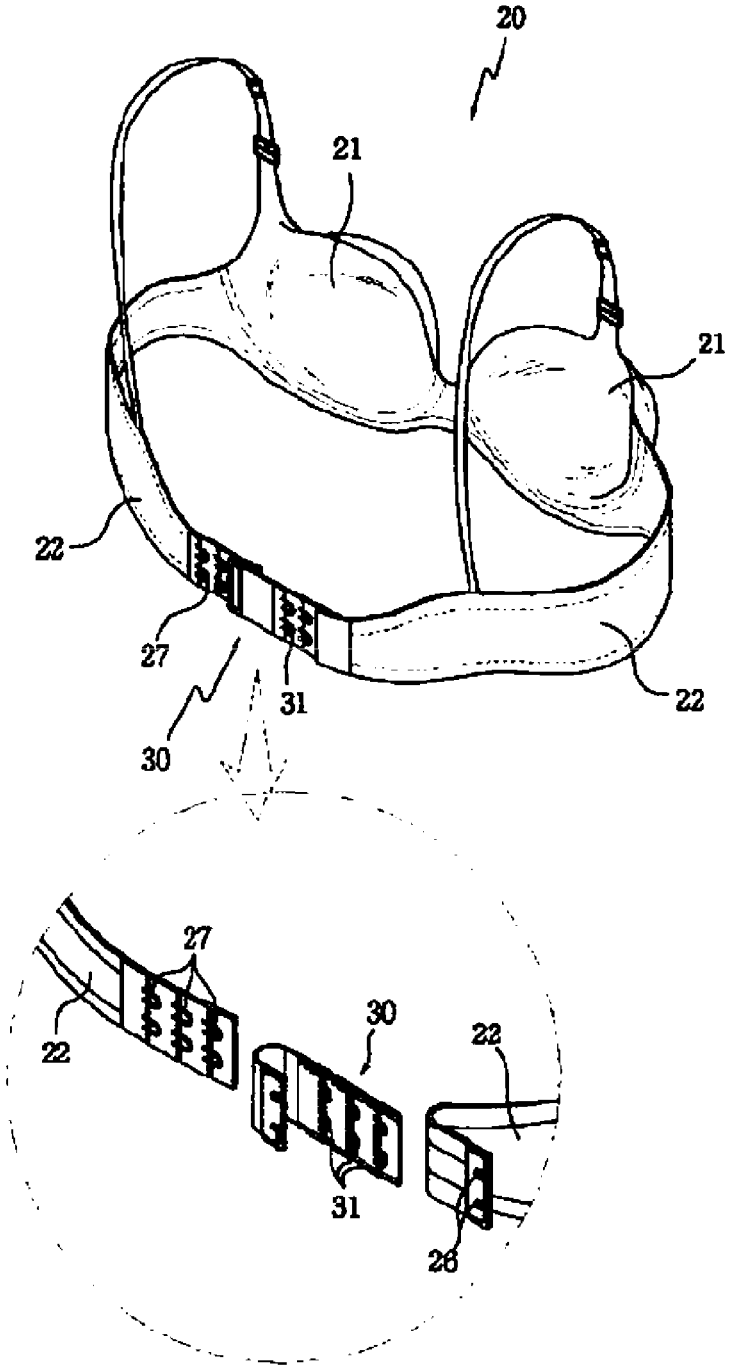

【Figure 4】
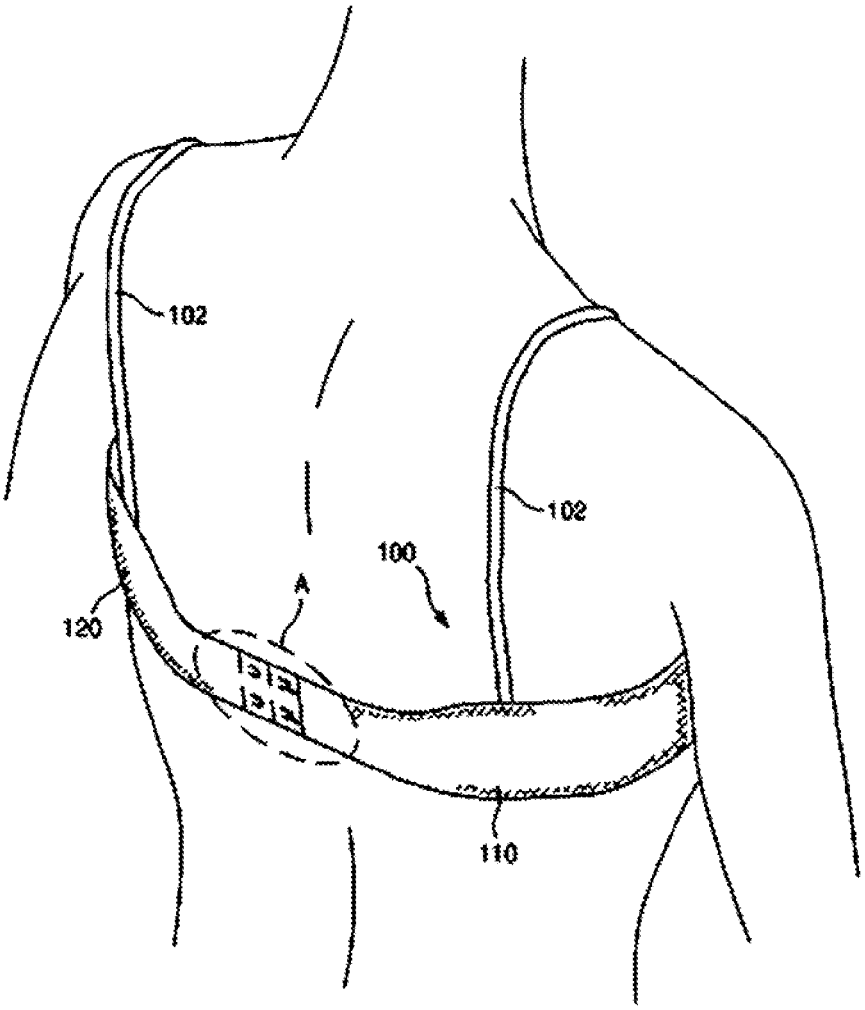
【Figure 5】
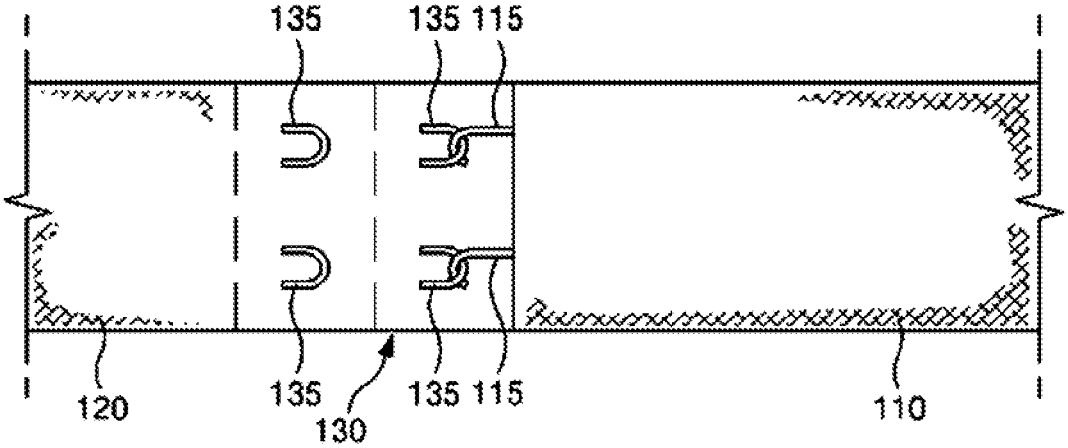

【Figure 6】
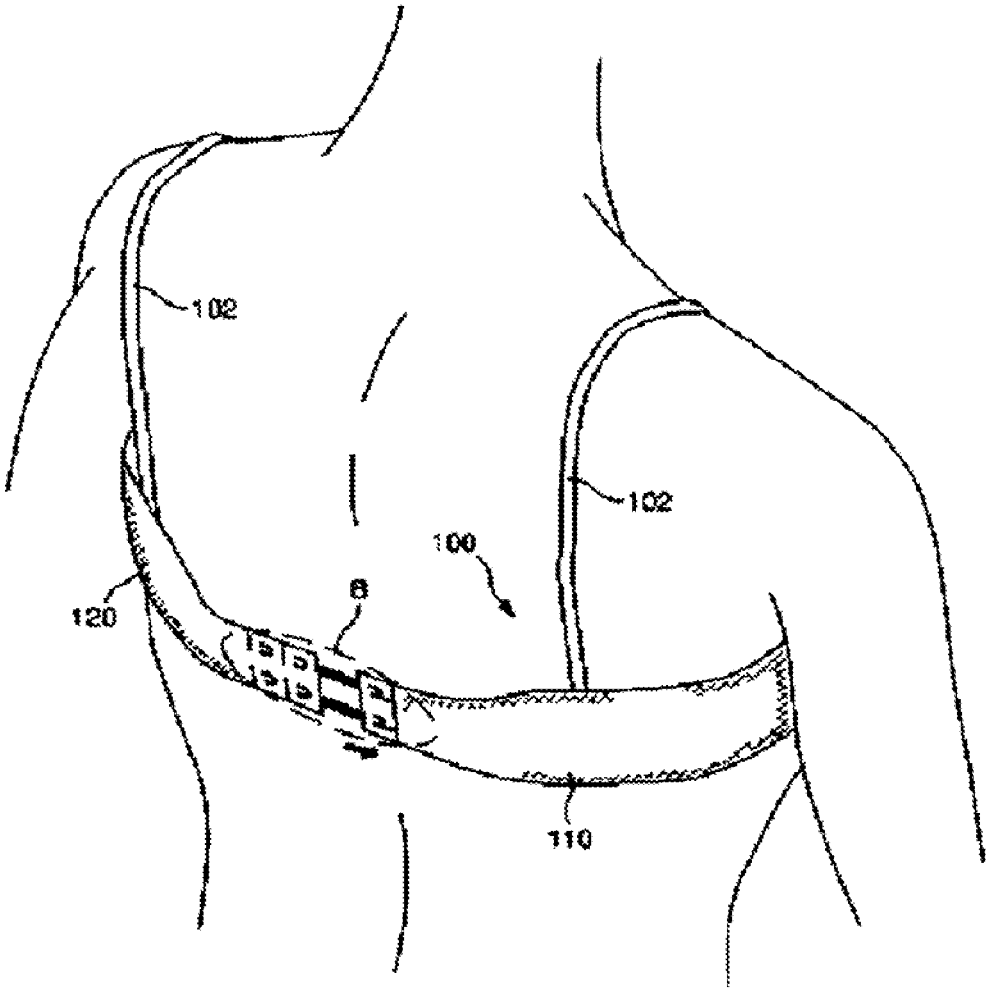
【Figure 7】
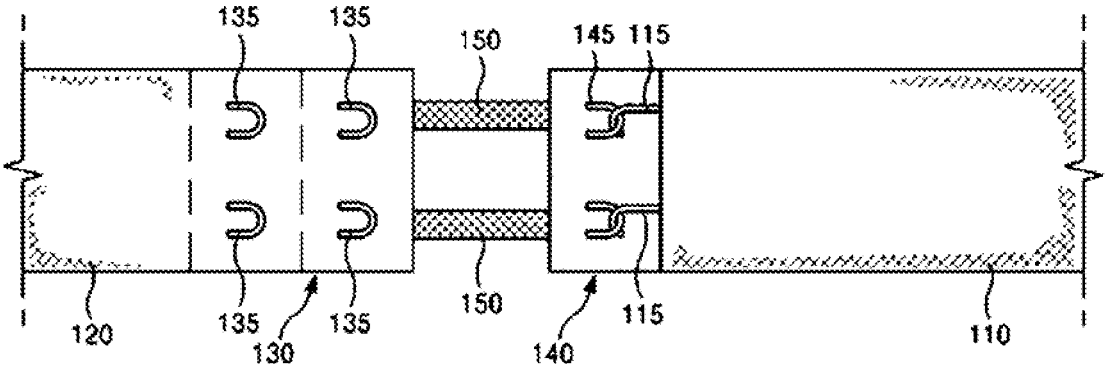

【Figure 8】
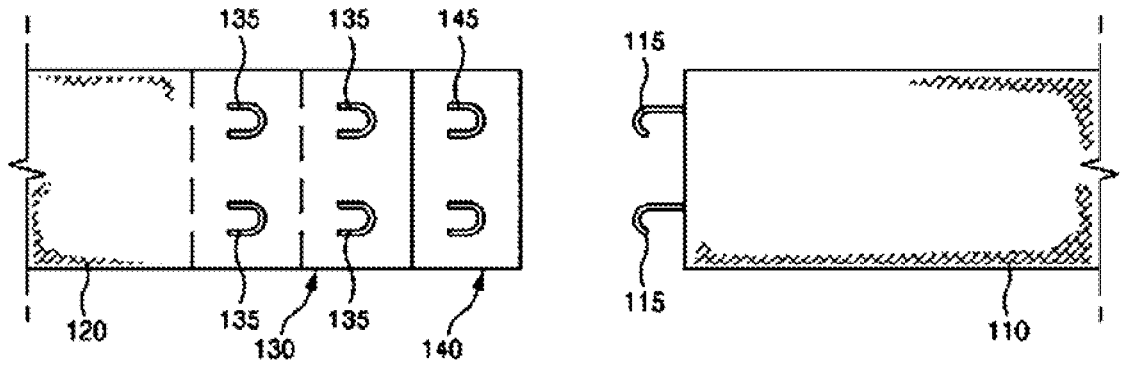
【Figure 9】
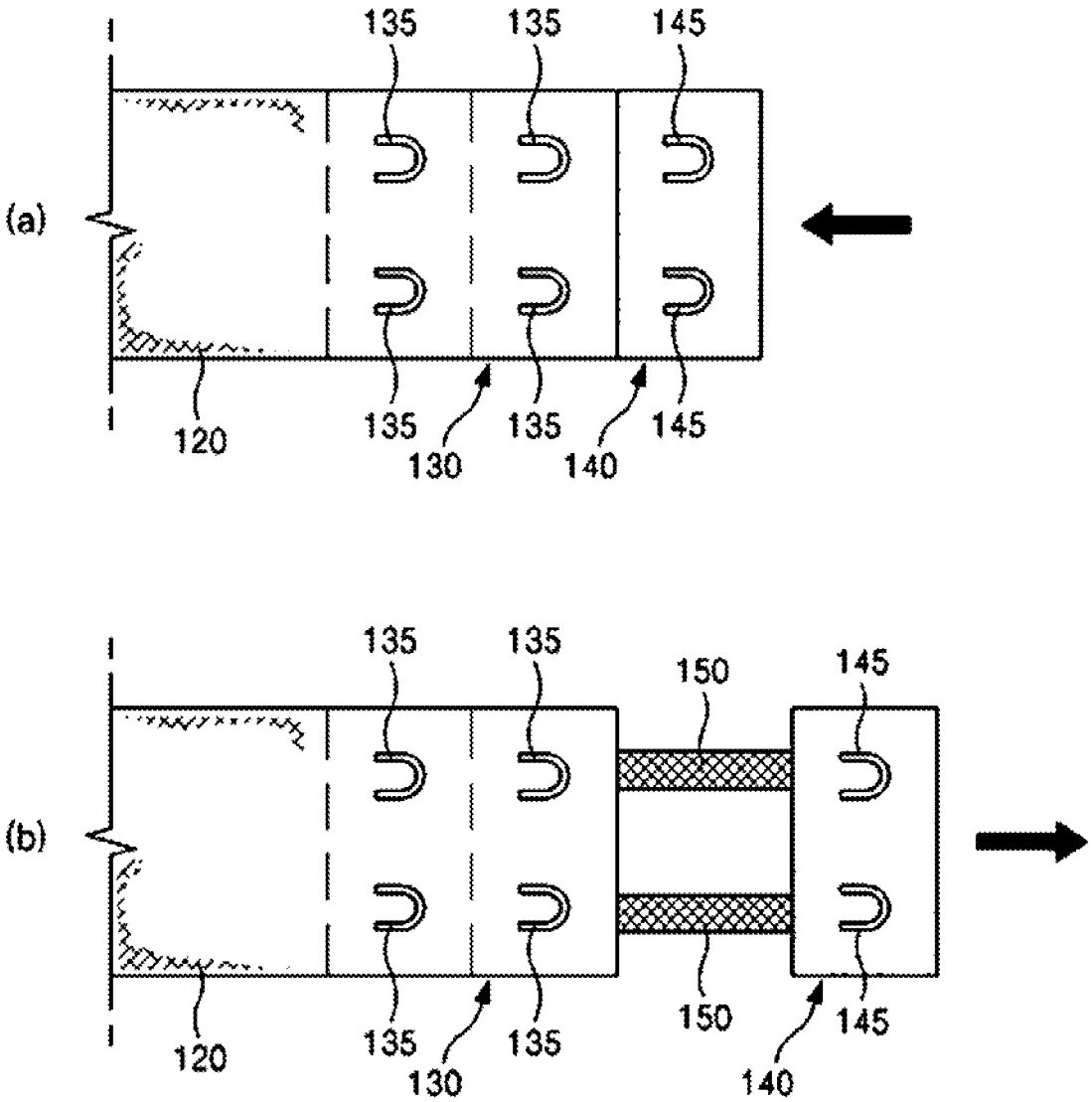

【Figure 10】
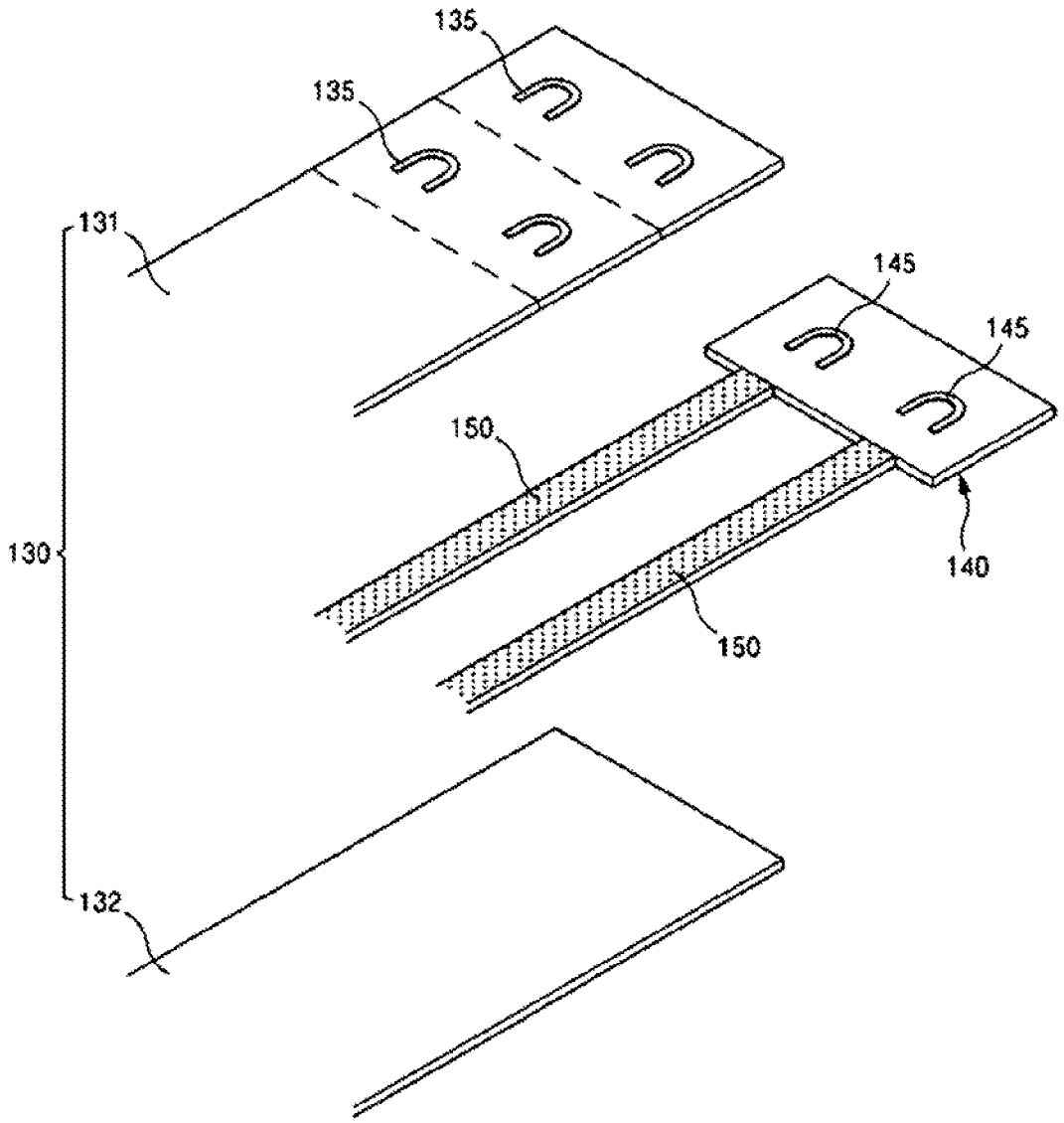
【Figure 11】
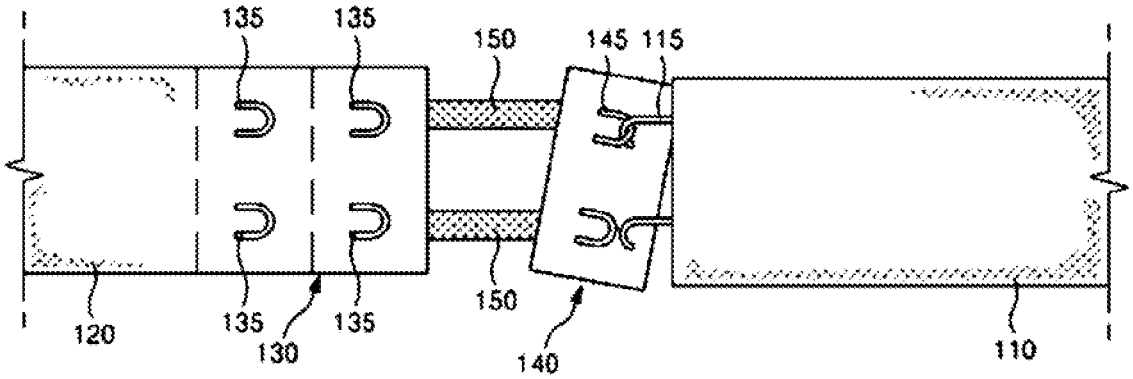

【Figure 12】
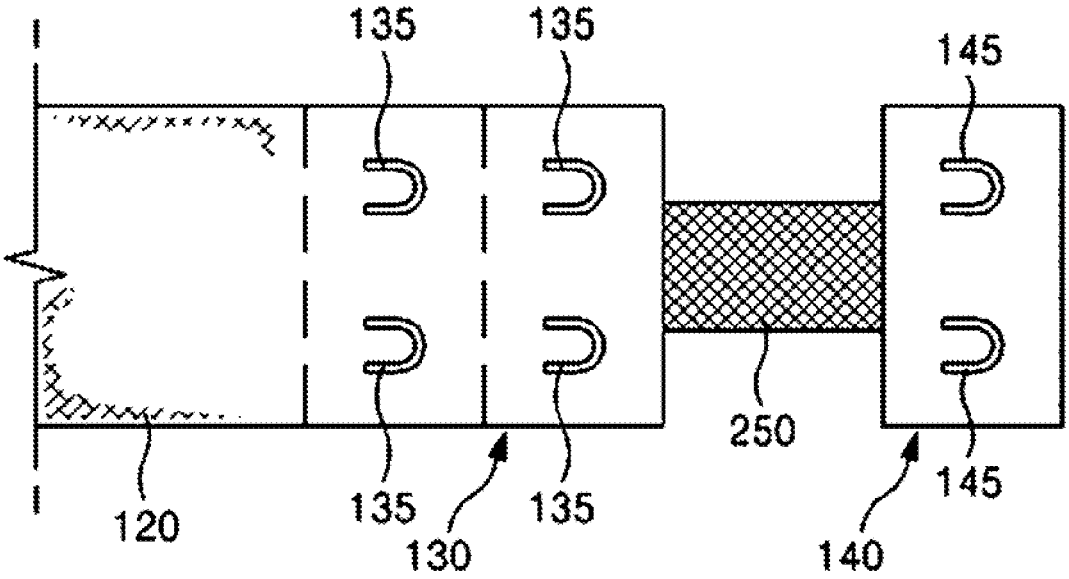
【Figure 13】
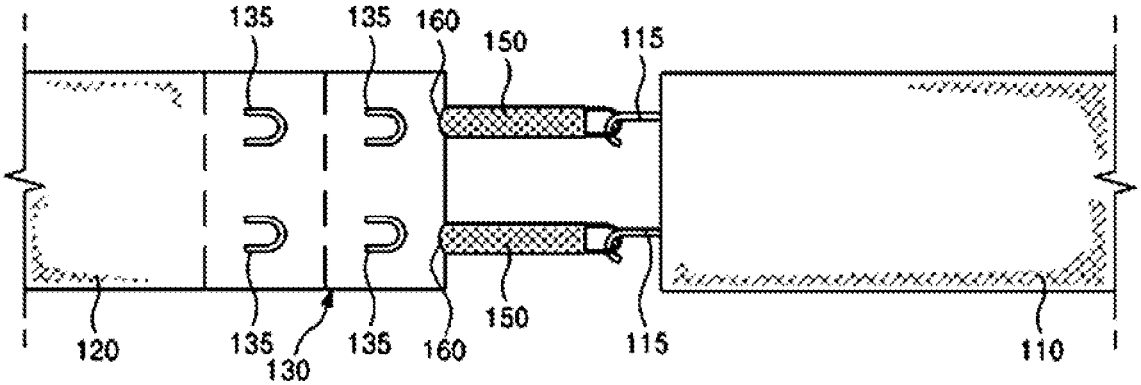

【Figure 14】
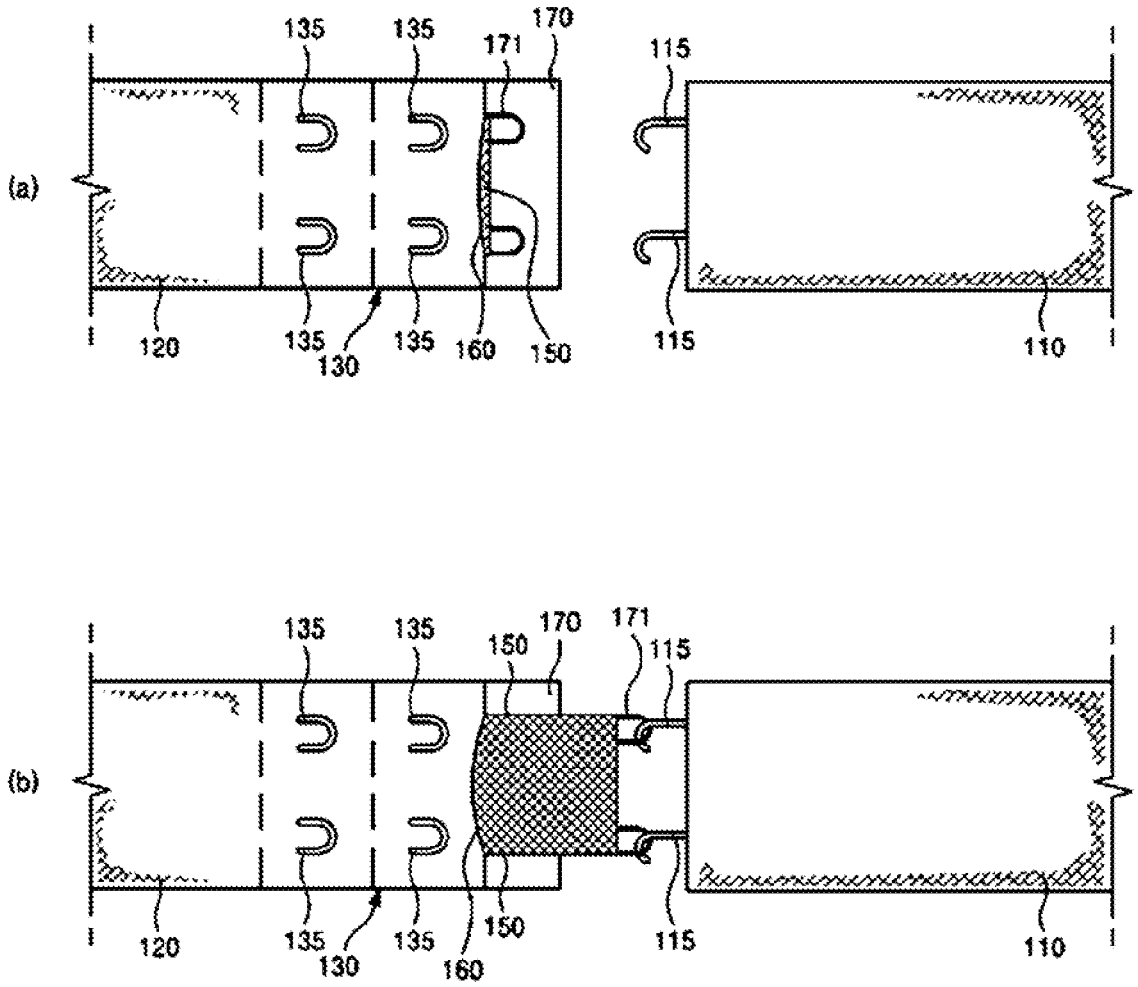

BRASSIERE

TECHNICAL FIELD

The present invention relates to a brassiere that uses a flexible band such that the girth of the brassiere may resiliently be altered, which allows for free adjustment of sizes, thereby providing relaxation-like comfort to a user wearing the brassiere.

BACKGROUND ART

In general, brassieres are a type of underwear that supports and covers a woman's breasts beautifully and that compensates for defects of the breasts to make clothes look beautiful, thereby making the shape of the breasts beautiful and attractive.

FIGS. 1 through 3 are views illustrating a brassiere according to the related art. Referring to FIGS. 1 and 2, the brassiere 10 according to the related art includes a pair of cups 11, connecting bands 12 connected to left and right sides of the pair of cups 11 and coupled on a user's back, and a shoulder band 13 fixed while being hung on the user's shoulders by top ends of the pair of cups 11 and the connecting bands 12.

When the user puts on or takes off the brassiere 10, hooks 16 and a plurality of stopping loops 17, which are formed at ends of the connecting bands 12 formed at the left and right sides of the pair of cups 11, are fastened to each other or separated from each other. A resilience band 14 having a predetermined resilient force is sewn onto top and bottom ends of the connecting bands 12.

Here, in the structure of the hooks 16 and the stopping loops 17 located at ends of the connecting bands 12 at both ends of the brassiere, the hooks 16 are placed at an end of the one-side connection band 12, and a plurality of stopping loops 17 that correspond to the hooks 16 are placed at an end of the other-side connecting band 12.

A plurality of stopping loops 17, in general, approximately three stopping hooks 17, are spaced a predetermined distance apart from each other so that the fixed positions of the hooks may be adjusted according to the user's chest dimension.

However, a width for changing the size of the brassiere 10 having the shape shown in FIG. 1 is limited to the stopping loops 17 placed in the connecting bands 12 of the brassiere such that the brassiere 10 may not correspond to the user's various body dimensions. Thus, when the user's body dimensions are suddenly altered, the brassiere 10 may not properly correspond to the user's varying body dimensions such that a new brassiere is required to be purchased and worn.

In order to solve this problem, Korean Utility-model Registration No. 20-0303757 is disclosed.

As disclosed in the above Utility-model Registration, the brassiere 10 includes a plurality of hooks 26 placed at an end of one side of the connecting bands 22 outside the pair of cups 21, stopping loops 27 formed at an end of the other side of the connecting bands 22, and an extension band 30 that is placed between the hooks 26 and the stopping loops 27 so as to increase the size of the brassiere, as illustrated in FIG. 3.

Thus, the size of the brassiere is adjusted to correspond to the user's various body dimensions by using the extension band 30 placed between the hooks 26 and the stopping loops 27 for fastening the brassiere such that the user can wear the brassiere with more excellent fit.

However, as disclosed in the above Utility-model Registration, the extension band 30 of the brassiere is not fixed to the brassiere such that there is a worry about loss. Also, because size adjustment is performed only using a plurality of auxiliary stopping loops 31 placed in the extension band 30, there is a limitation in size adjustment.

Also, because the plurality of auxiliary stopping loops 31 should be provided in addition to the existing stopping loops 27, the exterior of the brassiere is coarse such that the effect of reviving a style is lowered.

PRIOR-ART DOCUMENT

Patent Document (Patent document 0001) 1. Korean Utility-model Registration No. 20-0303757 entitled "Brassiere" (Registration date: Jan. 28, 2003)

Technical Problem

The present invention is directed to providing a brassiere, whereby a retractile resilience band is provided between first and second connecting bands that extend from left and right sides of cups such that the girth of the brassiere may resiliently be altered, thereby allowing for free adjustment of sizes and for excellent fit and adhesion.

Technical Solution

One aspect of the present invention provides a brassiere including: first and second connecting bands extending from left and right sides of cups; a plurality of hooks provided on an end portion of the first connecting band; a plurality of stopping loops provided on an end portion of the second connecting band in multiple columns, the plurality of hooks provided to engage with, or to disengage from, the plurality of loops; and a resilience band provided between the first and second connecting bands, wherein the end portion of the second connecting band includes: a stationary band portion on which, among the plurality of stopping loops, stationary stopping loops, the positions of which are fixed, are arranged; and a mobile band portion on which, among the plurality of stopping loops, mobile stopping loops, the positions of which are movable, are arranged, wherein the mobile band portion may resiliently move toward or away from the stationary band portion.

Another aspect of the present invention provides a brassiere including: first and second connecting bands extending from left and right sides of cups; a plurality of hooks provided on an end portion of the first connecting band; a plurality of stopping loops provided on an end portion of the second connecting band in multiple columns, the plurality of hooks provided to engage with, or to disengage from, the plurality of loops; a resilience band provided between the first and second connecting bands; and an extension portion, a portion of which overlapping an end of the second connecting band, which has one end fixed to the second connecting band and at least one cut portion provided at an outside surface of the extension portion, wherein the resilience band is inserted into the second connecting band or is exposed to an outside of the second connecting band through the cut portion.

Advantageous Effects

As described above, in a brassiere according to the present invention, sizes may be freely adjusted.

In addition, even when a user moves his/her upper body due to exercise, or the like, fit and adhesion may not be altered.

DESCRIPTION OF DRAWINGS

FIG. 1 is a perspective view of a brassiere according to the related art.

FIG. 2 is an exploded perspective view of a hook portion of the brassiere of FIG. 1.

FIG. 3 is a perspective view of another brassiere according to a related art.

FIG. 4 is a view of a state in which a user puts on a brassiere according to a first embodiment of the present invention.

FIG. 5 is an enlarged view of a region A of FIG. 4.

FIG. 6 is a view of a state in which size of the brassiere in FIG. 4 has increased and has been adjusted.

FIG. 7 is an enlarged view of a region B of FIG. 6.

FIG. 8 is a view of a state in which a first connecting band and a second connecting band are separated from each other.

FIG. 9 is a view of an operation of a stationary band portion and a mobile band portion.

FIG. 10 is an exploded view of the stationary band portion and the mobile band portion.

FIG. 11 is a view of a state in which one hook is engaged with one mobile stopping loop.

FIG. 12 is a partially enlarged view of a brassiere according to a second embodiment of the present invention.

FIG. 13 is a partially enlarged view of a brassiere according to a third embodiment of the present invention.

FIG. 14 is partially enlarged view of a brassiere according to a fourth embodiment of the present invention.

MODES OF THE INVENTION

Hereinafter, a brassiere according to the present invention will be described in more detail through a detailed description of embodiments with reference to the accompanying drawings. In the description of the present invention, a detailed description of a related, commonly used technology that may unnecessarily obscure the subject matter of the invention is omitted. The terms to be described later are terms defined in consideration of their functions in the present invention and are variable according to a client's, an operator's, or a user's intention or practice, etc. Therefore, definitions should be made based on the contents of the present specification.

Like reference numerals in the drawings represent like elements.

FIG. 4 is a view of a state in which a user puts on a brassiere according to a first embodiment of the present invention, FIG. 5 is an enlarged view of a region A of FIG. 4, FIG. 6 is a view of a state in which the size of the brassiere in FIG. 4 is increased and adjusted, FIG. 7 is an enlarged view of a region B of FIG. 6, FIG. 8 is a view of a state in which a first connecting band and a second connecting band are separated from each other, FIG. 9 is a view of an operation of a stationary band portion and a mobile band portion, FIG. 10 is an exploded view of the stationary band portion and the mobile band portion, FIG. 11 is a view of a state in which one hook is engaged with one mobile stopping loop, FIG. 12 is a partially enlarged view of a brassiere according to a second embodiment of the present invention, FIG. 13 is a partially enlarged view of a brassiere according to a third embodiment of the present invention, and FIG. 14 is partially enlarged view of a brassiere according to a fourth embodiment of the present invention.

Referring to these drawings, a brassiere 100 according to the present embodiment may allow for free adjustment of sizes, thereby providing relaxation-like comfort to a user wearing the brassiere. The brassiere 100 includes first and second connecting bands 110 and 120 that extend from left and right sides of cups (not shown), and a shoulder-hanging string 102.

As illustrated in FIGS. 4 and 6, the first and second connecting bands 110 and 120 may surround the user's body and connect to each other at the user's back.

Also, as illustrated in FIGS. 5 and 7, a plurality of hooks 115 and a plurality of stopping loops 135 and 145 are provided in such a way that the first and second connecting bands 110 and 120 may be connected to each other.

The plurality of hooks 115 are a kind of loop provided at an end portion of the first connecting band 110. In the current embodiment, a pair of hooks 115 may be arranged in one column.

Unlike the pair of hooks 115 which are arranged in one column, the plurality of stopping loops 135 and 145 are provided on an end portion of the second connecting band 120 in multiple columns. Because the plurality of stopping loops 135 and 145 are provided in multiple columns, the pair of hooks 115 may be engaged with or disengaged from the stopping loops 135 and 145 in a properly located column among the stopping loops 135 and 145 in the multiple columns.

Meanwhile, in the current embodiment, a stationary band portion 130 in which stationary stopping loops 135 on which, among the plurality of stopping loops 135 and 145 in the multiple columns, stationary stopping loops 135, the positions of which are fixed, are arranged on an end portion of the second connecting band 120, and a mobile band portion 140 in which mobile stopping loops 145 on which, among the plurality of stopping loops 135 and 145 in the multiple columns, mobile stopping loops 145, the positions of which are movable, are arranged, wherein the mobile band portion 140 may resiliently move toward or away from the stationary band portion 130, are provided.

In other words, the stationary band portion 130 forms the end portion of the second connecting band 120, whereas the mobile band portion 140 resiliently moves toward or away from the stationary band portion 130, as illustrated in FIGS. 7 and 8.

In the current embodiment, a pair of stationary stopping loops 135 is arranged on the stationary band portion 130 in two columns, and a pair of mobile stopping loops 145 is arranged on the mobile band portion 140 in one column.

Needless to say, the aforementioned is merely an example, and a pair of stationary stopping loops 135 may be arranged on the stationary band portion 130 in three or more columns.

In this case, when the mobile band portion 140 is in contact with the stationary band portion 130, as illustrated in FIG. 8, spacing between the stationary stopping loops 135 and the mobile stopping loops 145 may be the same.

Meanwhile, the stationary band portion 130 may include a band outer cover 131 on which the stationary stopping loops 135 are arranged, and a band inner cover 132, which are sewn to the band outer cover 131 in the interior of the band outer cover 131 to form one body with the band outer cover 131, wherein a resilience band 150 is retractably disposed between the band inner cover 132 and the band outer cover 131, as illustrated in FIG. 10.

In this case, the resilience band 150 may be bound in a form as shown in FIG. 10.

Meanwhile, the resilience band 150 is provided in such a way that the mobile band portion 140 may resiliently move toward or away from the stationary band portion 130.

In the current embodiment, a pair of resilience bands 150 is provided. One end of each of the pair of resilience bands 150 is fixed to the second connecting band 120, and the other end thereof is connected to the mobile band portion 140 so that position movement of the mobile band portion 140 with respect to the stationary band portion 130 may be resiliently performed.

A function of the brassiere 100 having this configuration will now be described.

As illustrated in FIGS. 4 and 5, the hooks 115 of the first connecting band 110 are engaged with one stationary stopping loop 135 placed in the stationary band portion 130 of the second connecting band 120 so that the user may put on the brassiere 100.

In order to provide relaxation-like comfort to the user by increasing the size in this state, the hooks 115 of the first connecting band 110 are engaged with the mobile stopping loops 145 placed in the mobile band portion 140 of the second connecting band 120, as illustrated in FIGS. 6 and 7. Then, the resilience band 150 expands, and the size is increased by the expansion of the resilience band 150, and thus it is possible to provide relaxation-like comfort to the user.

In this case, it may be stable to engage all of a pair of hooks 115 of the first connecting band 110 with a pair of mobile stopping loops 145 placed in the mobile band portion 140 of the second connecting band 120. Even though one hook 115 may be engaged with one mobile stopping loop 145 and the resilience band 150 expands, as illustrated in FIG. 11, the position of another mobile stopping loop 145 with which no hooks 115 are engaged, is moved together with the mobile band portion 140. Thus, the user may easily engage the other hooks 115 with the mobile stopping loops 145 without looking at a mirror.

FIG. 12 is a partially enlarged view of a brassiere according to a second embodiment of the present invention. Referring to FIG. 12, in the current embodiment, one wide resilience band 150 placed between the stationary band portion 130 and the mobile band portion 140 is disposed in the center of the brassiere. There is no problem in moving the mobile band portion 140 resiliently even when such a structure is used in the brassiere.

Even when the second embodiment is applied, the size may be quite freely adjusted so that it is possible to provide relaxation-like comfort to the user wearing the brassiere.

FIG. 13 is a partially enlarged view of a brassiere according to a third embodiment of the present invention. Referring to FIG. 13, in the third embodiment of the present invention, in a state in which the resilience band 150 is movably inserted using a cut portion 160 having one side coupled to a second connecting band 120 and the other side formed at an outside surface of the second connecting band 120, a pair of mobile stopping loops 145 is fixed. Here, the resilience band 150 is fixed to the second connecting band 120 through sewing in a state in which a portion to which a pair of mobile stopping loops 145 is fixed, is placed outside the cut portion 160 and an opposite portion is concealed inside a pair of stationary stopping loops 135.

The third embodiment of the present invention is a modification of the first embodiment of the present invention, and even though such a structure is applied to the third embodiment, the size may be quite freely adjusted such that it is possible to provide relaxation-like comfort to the user wearing the brassiere.

FIG. 14 is a partially enlarged view of a brassiere according to a fourth embodiment of the present invention. Referring to FIG. 14, the fourth embodiment of the present invention includes an extension portion 170 inserted into the second connecting band 120. The extension portion 170 includes a resilience band 150 having one side coupled to the extension portion 170 and a pair of extension loops 171 having a semicircular loop shape and coupled to the other side of the resilience band 150.

A pair of extension loops 171 is fixed to the resilience band 150 in a state in which the resilience band 150 is movably inserted using a cut portion 160 having one side coupled to the extension portion 170 and the other side formed at an outside surface of the extension portion 170. That is, the resilience band 150 is fixed to the extension portion 170 through sewing in a state in which a portion to which the pair of extension loops 171 are fixed, is placed outside the cut portion 160 and an opposite portion is concealed inside the second connecting band 120.

A portion of the extension portion 170 is disposed to overlap an end of the second connecting band 120, and one side of the extension portion 170 is fixed to the second connecting band 120 through sewing, and the other side of the extension portion 170 constitutes the cut portion 160 so that the resilience band 150 is movable to an outside surface of the extension portion 170, and the extension portion 170 is fixed to a distal end of the second connecting band 120 through sewing. Thus, even when such a structure is applied to the fourth embodiment, the size may be quite freely adjusted such that it is possible to provide relaxation-like comfort to the user wearing the brassiere.

In the brassiere according to the present invention described above, the size may be quite freely adjusted. Also, even when the user moves his/her own upper body due to exercise, or the like, fit and adhesion may not be altered.

Although, in the embodiments of the present invention, a pair of hooks is arranged on an end portion of the first connecting band in one column, a pair of mobile stopping loops is arranged on the mobile band portion in one column, and a pair of stationary stopping loops is arranged on the stationary band portion in two columns, embodiments of the present invention are not limited thereto, and at least one hook may be arranged on the end portion of the first connecting band, at least one mobile stopping loop may be arranged on the mobile band portion or on a resilience band, and at least one stationary stopping loop may be arranged on the stationary band portion.

While the invention has been shown and described with reference to certain exemplary embodiments thereof, it will be understood by those skilled in the art that various changes in form and details may be made therein without departing from the spirit and scope of the invention as defined by the appended claims.

LIST OF REFERENCE NUMERALS

100: brassiere
110: first connecting band
115: hook
120: second connecting band
130: stationary band portion
131: band outer cover
132: band inner cover
135: stationary stopping loop

140: mobile band portion
145: mobile stopping loop
150: resilience band
160: cut portion

The invention claimed is:

1. A brassiere comprising: first and second connecting bands extending from left and right sides of cups; a plurality of hooks provided on an end portion of the first connecting band; a plurality of stopping loops including stationary stopping loops and mobile stopping loops, the plurality of stopping loops provided on an end portion of the second connecting band in multiple columns, the plurality of hooks provided to engage with, or to disengage from, the plurality of loops; and a pair of resilience bands provided between the first and second connecting bands, wherein the end portion of the second connecting band comprises:

a stationary band portion including the stationary stopping loops; and a mobile band portion including the mobile stopping loops, wherein the mobile band portion is configured to resiliently move toward or away from the stationary band portion, wherein one end of the pair of resilience bands is fixed to the second connecting band, and the other end of the pair of resilience bands is directly connected to the mobile band portion wherein the mobile stopping loops are not directly connected to the pair of resilience bands;

wherein, when the mobile band portion is in contact with the stationary band portion, spacing between the stationary stopping loops and the mobile stopping loops are the same.

2. The brassiere of claim 1, wherein the stationary band portion comprises:

a band outer cover on which the stationary stopping loops are arranged; and a band inner cover, which is sewn to the band outer cover in an interior of the band outer cover to form one body with the band outer cover, wherein the pair of resilience bands are retractably disposed between the band inner cover and the band outer cover.

3. The brassiere of claim 1, wherein at least one stationary stopping loop is arranged on the stationary band portion, at least one mobile stopping loop is arranged on the mobile band portion, and at least one hook is arranged on an end portion of the first connecting band.

* * * * *